US011932822B2

(12) United States Patent
Horita et al.

(10) Patent No.: US 11,932,822 B2
(45) Date of Patent: Mar. 19, 2024

(54) LUBRICATING OIL COMPOSITION

(71) Applicant: IDEMITSU KOSAN CO., LTD., Chiyoda-ku (JP)

(72) Inventors: Naoto Horita, Funabashi (JP); Hiroshi Oki, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 17/622,026

(22) PCT Filed: Jun. 26, 2020

(86) PCT No.: PCT/JP2020/025315
§ 371 (c)(1),
(2) Date: Dec. 22, 2021

(87) PCT Pub. No.: WO2020/262639
PCT Pub. Date: Dec. 30, 2020

(65) Prior Publication Data

US 2022/0275301 A1 Sep. 1, 2022

(30) Foreign Application Priority Data

Jun. 28, 2019 (JP) ..... 2019-121966

(51) Int. Cl.

| | |
|---|---|
| ***C10M 133/16*** | (2006.01) |
| ***C10M 135/10*** | (2006.01) |
| ***C10M 137/10*** | (2006.01) |
| ***C10M 143/02*** | (2006.01) |
| ***C10M 143/04*** | (2006.01) |
| ***C10M 145/14*** | (2006.01) |
| ***C10M 169/04*** | (2006.01) |
| *C10N 10/04* | (2006.01) |
| *C10N 10/06* | (2006.01) |
| *C10N 20/02* | (2006.01) |
| *C10N 20/04* | (2006.01) |
| *C10N 30/00* | (2006.01) |
| *C10N 30/02* | (2006.01) |
| *C10N 30/04* | (2006.01) |
| *C10N 30/06* | (2006.01) |
| *C10N 40/25* | (2006.01) |

(52) U.S. Cl.

CPC ..... *C10M 133/16* (2013.01); *C10M 135/10* (2013.01); *C10M 137/10* (2013.01); *C10M 143/02* (2013.01); *C10M 143/04* (2013.01); *C10M 145/14* (2013.01); *C10M 169/044* (2013.01); *C10M 2205/022* (2013.01); *C10M 2205/024* (2013.01); *C10M 2209/084* (2013.01); *C10M 2215/086* (2013.01); *C10M 2219/044* (2013.01); *C10M 2223/045* (2013.01); *C10N 2010/04* (2013.01); *C10N 2010/06* (2013.01); *C10N 2020/02* (2013.01); *C10N 2020/04* (2013.01); *C10N 2030/02* (2013.01); *C10N 2030/04* (2013.01); *C10N 2030/06* (2013.01); *C10N 2030/54* (2020.05); *C10N 2030/56* (2020.05); *C10N 2040/25* (2013.01)

(58) Field of Classification Search

CPC ..... C10M 133/16; C10M 135/10; C10M 137/10; C10M 143/02; C10M 143/04; C10M 145/14; C10M 169/044; C10M 2209/084; C10M 2215/086; C10M 2219/044; C10M 2223/045

See application file for complete search history.

(56) References Cited

U.S. PATENT DOCUMENTS

| | | | | |
|---|---|---|---|---|
| 2010/0048440 | A1 | 2/2010 | Fujita et al. | |
| 2015/0322368 | A1 | 11/2015 | Patel et al. | |
| 2017/0198234 | A1* | 7/2017 | Matsuki | C10M 141/10 |
| 2017/0321146 | A1* | 11/2017 | Fletcher | C10M 137/10 |
| 2018/0066203 | A1* | 3/2018 | Dance | C10M 169/04 |
| 2018/0237722 | A1* | 8/2018 | Burns, III | C10M 133/12 |
| 2019/0330555 | A1* | 10/2019 | Yang | C10M 163/00 |

(Continued)

FOREIGN PATENT DOCUMENTS

| | | | |
|---|---|---|---|
| EP | 1 055 722 | A1 | 11/2000 |
| JP | 9-202890 | A | 8/1997 |

(Continued)

OTHER PUBLICATIONS

International Search Report dated Sep. 8, 2020 in PCT/JP2020/025315, filed on Jun. 26, 2020, 3 pages.

Singaporean Office Action dated Feb. 27, 2023 in Singaporean Patent Application No. 11202114160P, 7 pages.

Office Action dated Sep. 5, 2023, in corresponding Japanese Patent Application No. 2021-527787 (with English Translation), 8 pages.

Official communication issued in IN application 202147059919 dated Oct. 23, 2023.

(Continued)

*Primary Examiner* — Ellen M McAvoy

(74) *Attorney, Agent, or Firm* — Oblon, McClelland, Maier & Neustadt, L.L.P.

(57) ABSTRACT

There is provided a lubricating oil composition which is excellent in the wear resistance and the oil film retention even when the viscosity of the composition is lowered. The lubricating oil composition comprises: a base oil (A); an imide compound (B); a calcium-based detergent (C); a polymer component (D); and a zinc dithiophosphate (E), wherein the imide compound (B) comprises at least one non-boron-modified succinic acid imide compound (Bx) selected from a succinic acid monoimide (B1x) represented by general formula (b-1) and a succinic acid bisimide (B2x) represented by general formula (b-2), and wherein the polymer compound (D) has a mass average molecular weight (Mw) of not less than 10,000 and not more than 50,000, and comprises at least one selected from an olefin polymer (D1) and a polymethacrylate (D2).

20 Claims, No Drawings

(56) References Cited

U.S. PATENT DOCUMENTS

| | | | | |
|---|---|---|---|---|
| 2019/0367834 | A1* | 12/2019 | Inoue | C10M 137/10 |
| 2020/0048576 | A1 | 2/2020 | Horita et al. | |
| 2020/0407660 | A1* | 12/2020 | Komatsubara | C10M 129/74 |
| 2021/0047581 | A1* | 2/2021 | Kasai | C10M 141/10 |
| 2021/0095221 | A1 | 4/2021 | Matsubara et al. | |
| 2022/0169946 | A1* | 6/2022 | Kusumoto | C10M 129/54 |

FOREIGN PATENT DOCUMENTS

| | | | |
|---|---|---|---|
| JP | 2004-137317 | A | 5/2004 |
| JP | 2008-106199 | | 5/2008 |
| JP | 2008-208221 | A | 9/2008 |
| JP | 2008-248213 | | 10/2008 |
| JP | 2011-63654 | | 3/2011 |
| JP | 2012-107143 | A | 6/2012 |
| JP | 2015-147890 | A1 | 8/2015 |
| JP | 2016-148004 | | 8/2016 |
| JP | 2017-514983 | A1 | 6/2017 |
| JP | 2018-62551 | A | 4/2018 |
| JP | 2018-168341 | A | 11/2018 |
| WO | WO 2019/003573 | A1 | 1/2019 |

OTHER PUBLICATIONS

Japanese Office Action dated Jan. 30, 2024 in Japanese Patent Application No. 2021-527787, filed on Jun. 26, 2020, (w/computer-generated English translation), 5 pages.

* cited by examiner

LUBRICATING OIL COMPOSITION

TECHNICAL FIELD

The present invention relates to a lubricating oil composition.

BACKGROUND ART

In recent years, vehicles such as automobiles are required to have improved fuel economy in order to reduce the environmental burden.

As a method for improving fuel economy, a method is known which involves lowering the viscosity of a lubricating oil composition to reduce the viscous resistance of the lubricating oil composition, thereby reducing energy loss (see, for example, patent document 1).

CITATION LIST

Patent Literature

Patent document 1: Japanese Patent Laid-Open Publication No. 2004-137317

SUMMARY OF INVENTION

Technical Problem

However, when the viscosity of a lubricating oil composition is lowered, an oil film can hardly be retained appropriately e.g. on a sliding portion in an engine, whereby an engine part, etc. are likely to be damaged due to their fatigue or wear. A demand therefore exists for a lubricating oil composition having prolonged fatigue life and enhanced wear resistance. The property of retaining an oil film is hereinafter also referred to as "oil film retention".

The present invention has been made in view of the above problems. It is therefore an object of the present invention to provide a lubricating oil composition which is excellent in the wear resistance and the oil film retention even when the viscosity of the lubricating oil composition is lowered.

Solution to Problem

The present inventors have found that the above problems can be solved by a lubricating oil composition comprising a base oil (A), a particular imide compound (B), a calcium-based detergent (C), a particular polymer component (D), and a zinc dithiophosphate (E), and have accomplished the present invention based on the finding.

Thus, the present invention provides the following [1] to [9].

[1] A lubricating oil composition comprising: a base oil (A); an imide compound (B); a calcium-based detergent (C); a polymer component (D); and a zinc dithiophosphate (E), wherein the imide compound (B) comprises at least one non-boron-modified succinic acid imide compound (Bx) selected from a succinic acid monoimide (B1x) represented by the following general formula (b-1) and a succinic acid bisimide (B2x) represented by the following general formula (b-2):

(b-1)

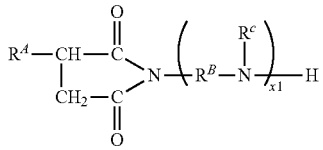

(b-2)

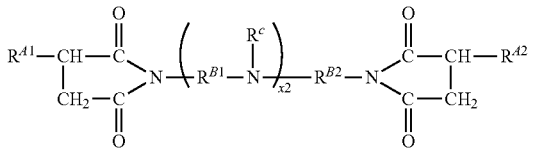

wherein $R^A$, $R^{A1}$, and $R^{A2}$ are each independently an alkenyl group having a mass average molecular weight (Mw) of 500 to 4,000, $R^B$, $R^{B1}$, and $R^{B2}$ are each independently an alkylene group having 2 to 5 carbon atoms, $R^C$ is an alkyl group having 1 to 10 carbon atoms or a group represented by $—(AO)_n$-H where A represents an alkylene group having 2 to 4 carbon atoms, and n represents an integer of 1 to 10, and x1 is an integer of 1 to 10, and x2 is an integer of 1 to 10, and wherein the polymer compound (D) has a mass average molecular weight (Mw) of not less than 10,000 and not more than 50,000, and comprises at least one selected from an olefin polymer (D1) and a polymethacrylate (D2).

[2] The lubricating oil composition as described in [1] above, wherein the imide compound (B) further comprises at least one boron-modified succinic acid imide compound (By) selected from a boron-modified product (B1y) of the succinic acid monoimide (B1x) and a boron-modified product (B2y) of the succinic acid bisimide (B2x), and wherein the content of boron atoms (By-B) derived from the boron-modified succinic acid imide compound (By) is not more than 0.020% by mass based on the total amount of the lubricating oil composition.

[3] The lubricating oil composition as described in [2] above, wherein the mass ratio [(By-B)/(B-N)] of the content of boron atoms (By-B) derived from the boron-modified succinic acid imide compound (By) to the content of nitrogen atoms (B-N) derived from the imide compound (B) is not more than 1.0.

[4] The lubricating oil composition as described in any one of [1] to [3] above, wherein the mass ratio [(E-P)/(B-N)] of the content of phosphorus atoms (E-P) derived from the zinc dithiophosphate (E) to the content of nitrogen atoms (B-N) derived from the imide compound (B) is not less than 0.5 and not more than 5.0.

[5] The lubricating oil composition as described in any one of [1] to [4] above, wherein the content of nitrogen atoms (N) is not less than 0.010% by mass and not more than 0.10% by mass based on the total amount of the lubricating oil composition.

[6] The lubricating oil composition as described in any one of [1] to [5] above, wherein the calcium-based detergent (C) is a calcium sulfonate.

[7] The lubricating oil composition as described in any one of [1] to [6] above, wherein the kinematic viscosity of the composition at 100° C. is not less than 4.0 $mm^2/s$ and the kinematic viscosity of the composition at 100° C. is less than 20.0 $mm^2/s$.

[8] The lubricating oil composition as described in any one of [1] to [7] above, which is to be used in an internal combustion engine of a motorcycle.

[9] A method for producing a lubricating oil composition, comprising a step of mixing a base oil (A), an imide compound (B), a calcium-based detergent (C), a polymer component (D), and a zinc dithiophosphate (E), wherein the imide compound (B) comprises at least one non-boron-modified succinic acid imide compound (Bx) selected from a succinic acid monoimide (B1x) represented by the following general formula (b-1) and a succinic acid bisimide (B2x) represented by the following general formula (b-2):

(b-1)

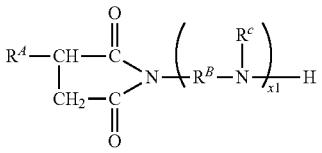

(b-2)

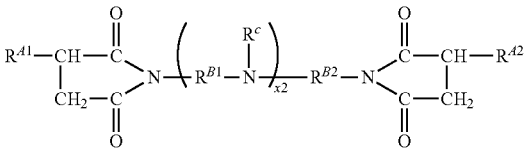

wherein $R^A$, $R^{A1}$, and $R^{A2}$ are each independently an alkenyl group having a mass average molecular weight (Mw) of 500 to 4,000, $R^B$, $R^{B1}$, and $R^{B2}$ are each independently an alkylene group having 2 to 5 carbon atoms, $R^C$ is an alkyl group having 1 to 10 carbon atoms or a group represented by —$(AO)_n$-H where A represents an alkylene group having 2 to 4 carbon atoms, and n represents an integer of 1 to 10, and x1 is an integer of 1 to 10, and x2 is an integer of 1 to 10, and wherein the polymer compound (D) has a mass average molecular weight (Mw) of not less than 10,000 and not more than 50,000, and comprises at least one selected from an olefin polymer (D1) and a polymethacrylate (D2).

Advantageous Effects of Invention

According to the present invention, it is possible to provide a lubricating oil composition which is excellent in the wear resistance and the oil film retention even when the viscosity of the lubricating oil composition is lowered.

Description of Embodiments

Lower limit values and upper limit values, which are herein defined in preferable numerical ranges (e.g., content ranges) and set forth in a stepwise manner, can be combined independently. For example, from the phrase "preferably 10 to 90, more preferably 30 to 60", the "preferable lower limit value (10)" and the "more preferable upper limit value (60)" can be combined to define the range "10 to 60". Similarly, numerical values accompanied by phrases such as "not less than", "not more than", "less than" and "more than", can be arbitrarily combined herein.

[Lubricating Oil Composition]

A lubricating oil composition according to an embodiment comprises: a base oil (A); an imide compound (B); a calcium-based detergent (C); a polymer component (D); and a zinc dithiophosphate (E), wherein the imide compound (B) comprises at least one non-boron-modified succinic acid imide compound (Bx) selected from a succinic acid monoimide (B1x) represented by the following general formula (b-1) and a succinic acid bisimide (B2x) represented by the following general formula (b-2):

(b-1)

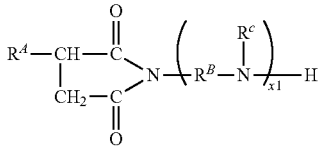

(b-2)

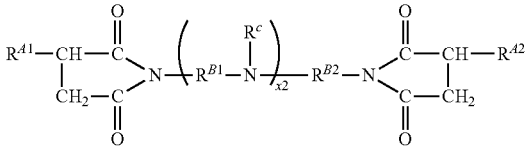

wherein $R^A$, $R^{A1}$, and $R^{A2}$ are each independently an alkenyl group having a mass average molecular weight (Mw) of 500 to 4,000, $R^B$, $R^{B1}$, and $R^{B2}$ are each independently an alkylene group having 2 to 5 carbon atoms, $R^C$ is an alkyl group having 1 to 10 carbon atoms or a group represented by —$(AO)_n$-H where A represents an alkylene group having 2 to 4 carbon atoms, and n represents an integer of 1 to 10, and x1 is an integer of 1 to 10, and x2 is an integer of 1 to 10, and wherein the polymer compound (D) has a mass average molecular weight (Mw) of not less than 10,000 and not more than 50,000, and comprises at least one selected from an olefin polymer (D1) and a polymethacrylate (D2).

When the viscosity of a lubricating oil composition is lowered in order to improve the fuel economy, the thickness of an oil film will be reduced, leading to a reduction in the oil film retention. The present inventors, through intensive studies, have found that the inclusion of the base oil (A) and the polymer compound (D) having a particular mass average molecular weight (Mw) in the lubricating oil composition enhances the oil film retention.

The lubricating oil composition also contains the imide compound (B) and the calcium-based detergent (C) from the viewpoint of ensuring high-temperature detergency, etc. Further, the lubricating oil composition also contains the zinc dithiophosphate (E) from the viewpoint of ensuring wear resistance.

The present inventors' intensive studies have revealed that when the imide compound (B) is a non-capped succinic acid imide compound (B'), i.e. when $R^C$ in the general formula (b-1) and the general formula (b-2) is a hydrogen atom, the lubricating oil composition has poor wear resistance. This may be because in the case of a non-capped succinic acid imide compound (B'), the hydrogen atom situated in the $R^C$ position is an active amine hydrogen having high reactivity. The active amine hydrogen will impair the function of the zinc dithiophosphate (E) as a friction adjuster, thereby reducing the wear resistance enhancing effect of the zinc dithiophosphate (E).

The present inventors have found that the use of the particular non-boron-modified succinic acid imide compound (Bx), having a structure (capped structure) in which a hydrogen atom is substituted e.g. with the alkyl group in the $R^C$ position in the general formula (b-1) and the general formula (b-2), as the imide compound (B) can achieve a sufficiently high wear resistance without reducing the wear resistance enhancing effect of the zinc dithiophosphate (E). This may be because the non-boron-modified succinic acid imide compound (Bx), which has no active amine hydrogen, does not have the above-described effect on the zinc dithiophosphate (E) and does not reduce the wear resistance enhancing effect of the zinc dithiophosphate (E).

In the lubricating oil composition of this embodiment, the total content of the base oil (A), the imide compound (B), the calcium-based detergent (C), the polymer component (D), and the zinc dithiophosphate (E) is preferably not less than 60% by mass, more preferably not less than 70% by mass, even more preferably not less than 80% by mass, and still more preferably not less than 90% by mass based on the total mount (100% by mass) of the lubricating oil composition.

In the lubricating oil composition of this embodiment, the upper limit of the total content of the base oil (A), the imide compound (B), the calcium-based detergent (C), the polymer component (D), and the zinc dithiophosphate (E) may be 100% by mass. When the lubricating oil composition contains an additive other than the base oil (A), the imide compound (B), the calcium-based detergent (C), the polymer component (D), and the zinc dithiophosphate (E), the total content of the components (A) to (E) may be adjusted in relation to the additive, and may preferably be not more than 99.5% by mass, more preferably not more than 99.0% by mass, and even more preferably be not more than 98.0% by mass.

The respective components of the lubricating oil composition of this embodiment will now be described.

<Base Oil (A)>

The lubricating oil composition of this embodiment contains the base oil (A). At least one oil, selected from mineral oils and synthetic oils that have been used as a base oil of a lubricating oil, can be used without limitation as the base oil (A).

Examples of the mineral oils include atmospheric residual oils obtained by subjecting a crude oil, such as a paraffinic crude oil, an intermediate crude oil or a naphthenic crude oil, to atmospheric distillation; vacuum residual oils obtained by subjecting such an atmospheric residual oil to vacuum distillation; and mineral oils obtaining by subjecting such a vacuum residual oil to at least one refining treatment, such as solvent deasphalting, solvent extraction, hydrofinishing, hydrocracking, advanced hydrocracking, solvent dewaxing, catalytic dewaxing, and hydroisomerization dewaxing.

Examples of the synthetic oils include poly-α-olefins, such as an α-olefin homopolymer and an α-olefin copolymer (for example, an α-olefin copolymer having 8 to 14 carbon atoms, such as an ethylene-α-olefin copolymer); isoparaffins; esters such as polyol esters and dibasic acid esters; ethers such as polyphenyl ethers; polyalkylene glycols; alkylbenzenes; alkylnaphthalenes; and GTL base oils obtained by isomerizing a wax (GTL wax (gas-to-liquids WAX)) produced from a natural gas e.g. by the Fischer-Tropsch process.

A base oil belonging to Group II or III of the API (American Petroleum Institute) Base Oil Category is preferred as a base oil for use in this embodiment.

A single mineral oil or a combination of two or more mineral oils, or a single synthetic oil or a combination of two or more synthetic oils may be used as the base oil (A). Further, a combination of one or more mineral oils and one or more synthetic oils may be used as the base oil (A).

While there is no particular limitation on the kinematic viscosity and the viscosity index of the base oil (A), they are preferably adjusted to the following ranges from the viewpoint of improving the oil film retention, the fuel economy and the wear resistance of the lubricating oil composition.

The kinematic viscosity of the base oil (A) at 40° C. (hereinafter also referred to as "40° C. kinematic viscosity") is preferably 2.0 $mm^2/s$ to 100.0 $mm^2/s$, more preferably 5.0 $mm^2/s$ to 80.0 $mm^2/s$, even more preferably 10.0 $mm^2/s$ to 60.0 $mm^2/s$, still more preferably 15 $mm^2/s$ to 55 $mm^2/s$, and yet more preferably 25 $mm^2/s$ to 45 $mm^2/s$.

The kinematic viscosity of the base oil (A) at 100° C. (hereinafter also referred to as "100° C. kinematic viscosity") is preferably 2.0 $mm^2/s$ to 20.0 $mm^2/s$, more preferably 3.0 $mm^2/s$ to 9.0 $mm^2/s$, even more preferably 4.0 $mm^2/s$ to 8.0 $mm^2/s$, and still more preferably 5.0 $mm^2/s$ to 7.0 $mm^2/s$.

The viscosity index of the base oil (A) is preferably not less than 80, more preferably not less than 90, even more preferably not less than 100, and still more preferably not less than 105.

The 40° C. kinematic viscosity, the 100° C. kinematic viscosity, and the viscosity index can be measured or calculated in accordance with JIS K 2283:2000.

When the base oil (A) is a mixed base oil comprising two or more base oils, it is preferred that the kinematic viscosity and the viscosity index of the mixed base oil lie in the above ranges.

While there is no particular limitation on the content of the base oil (A) in the lubricating oil composition of this embodiment, it is preferably 60% by mass to 99% by mass, more preferably 70% by mass to 98% by mass, and even more preferably 80% by mass to 97% by mass based on the total amount (100% by mass) of the lubricating oil composition from the viewpoint of better achieving the effect of the present invention.

<Imide Compound (B)>

The imide compound (B) comprises at least one non-boron-modified succinic acid imide compound (Bx) selected from a succinic acid monoimide (B1x) represented by the following general formula (b-1) and a succinic acid bisimide (B2x) represented by the following general formula (b-2).

In the lubricating oil composition of this embodiment, the imide compound (B) can function as an ash-free dispersant.

The imide compound (B) has a structure in which at least part of active amine hydrogens, contained in the succinic acid monoimide or succinic acid bisimide compound produced using a polyamine compound as a raw material, is substituted with a substituent ($R^C$ in the following general formulae (b-1) and (b-2)), such as an alkyl group.

The inclusion of the imide compound (B) in the lubricating oil composition of this embodiment can enhance the wear resistance.

If the lubricating oil composition of this embodiment does not contain the imide compound (B), or contains a different imide compound instead of the imide compound (B), the lubricating oil composition cannot achieve good wear resistance.

(b-1)

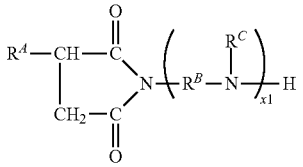

(b-2)

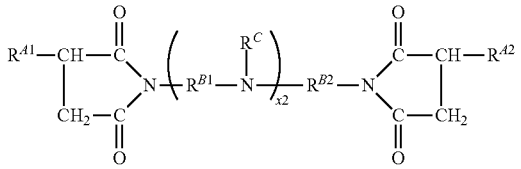

In the general formulae (b-1) and (b-2), $R^A$, $R^{A1}$, and $R^{A2}$ are each independently an alkenyl group having a mass average molecular weight (Mw) of 500 to 4,000.

Examples of the alkenyl group include a polybutenyl group, a polyisobutenyl group, and an ethylene-propylene copolymer. Among them, a polybutenyl group or a polyisobutenyl group is preferred, and a polyisobutenyl group is more preferred.

The mass average molecular weight (Mw) of the alkenyl group is 500 to 4,000, preferably 900 to 3,000, more preferably 1,300 to 2,800, and even more preferably 1,800 to 2,600.

In the present invention, the mass average molecular weight (Mw) of the alkenyl group can be measured for a polyolefin as a source of the alkenyl group, e.g. by using a GPC apparatus (HLC-8220, manufactured by Tosoh Corporation) equipped with columns (two TSKgel GMH-XL columns and one G2000H-XL column, manufactured by Tosoh Corporation) under the conditions of: detector: a refractive index detector, measurement temperature: 40° C., mobile phase: tetrahydrofuran, flow rate: 1.0 mL/min, and concentration: 0.5 mg/mL, and can be evaluated as a mass average molecular weight (Mw) as calculated in terms of standard polystyrene.

In an alternative method, the theoretical molecular weight of a structure corresponding to a moiety other than alkenyl groups is subtracted from the mass average molecular weight of the imide compound (B), measured by the above-described method, and the resulting value is divided by the number of the alkenyl groups contained in one molecule to obtain a value as the mass average molecular weight (Mw) of the alkenyl group.

$R^B$, $R^{B1}$, and $R^{B2}$ are each independently an alkylene group having 2 to 5 carbon atoms.

Examples of the alkylene group include a methylene group, an ethylene group, a trimethylene group, various butylene groups, and various pentylene groups. The expression "various" as used herein for e.g. butylene groups includes linear groups, branched groups, and isomers thereof.

$R^C$ is an alkyl group having 1 to 10 carbon atoms or a group represented by —$(AO)_n$-H where A represents an alkylene group having 2 to 4 carbon atoms, and n represents an integer of 1 to 10.

Examples of the alkyl group include linear or branched alkyl groups, such as a methyl group, an ethyl group, a propyl group, a butyl group, a pentyl group, a hexyl group, a heptyl group, an octyl group, a 1,1-dimethylhexyl group, a 2-ethylhexyl group, a nonyl group, a 1,1-dimethylheptyl group, and a decyl group.

Examples of the alkylene group having 2 to 4 carbon atoms, which is represented by A, include an ethylene group, a trimethylene group, and various butylene groups. Among them, an ethylene group is preferred.

n is an integer of 1 to 10, preferably an integer of 1 to 5, and more preferably an integer of 1 to 3.

x1 is an integer of 1 to 10, preferably an integer of 2 to 5, and more preferably 3 or 4.

x2 is an integer of 1 to 10, preferably an integer of 3 to 7, and more preferably 5 or 6.

The imide compound (B) may contain a succinic acid monoimide (B1x) in which in the general formula (b-1), $R^A$ is an alkyl group having a mass average molecular weight (Mw) of 500 to 4,000. The imide compound (B) may contain a succinic acid bisimide (B2x) in which in the general formula (b-2), $R^{A1}$ and $R^{A2}$ are each independently an alkyl group having a mass average molecular weight (Mw) of 500 to 4,000.

Succinic acid monoimides (B1x) may be used either singly or in a combination of two or more as the imide compound (B). Succinic acid bisimides (B2x) may be used either singly or in a combination of two or more as the imide compound (B). Further, a combination of at least one succinic acid monoimide (B1x) and at least one succinic acid bisimide (B2x) may be used as the imide compound (B).

The non-boron-modified succinic acid imide compound (Bx) can be produced, for example, by reacting an alkenyl succinic anhydride, obtained through a reaction between a polyolefin and maleic anhydride, with a polyamine to prepare an alkenyl succinic acid imide having active amine hydrogens (compound represented by the general formula (b-1) or the general formula (b-2), wherein $R^C$ is a hydrogen atom), and substituting at least part of the active amine hydrogens with the group represented by $R^C$.

The polyolefin is, for example, a polymer obtained through polymerization of one or more α-olefins having 2 to 8 carbon atoms, and a copolymer of isobutene and 1-butene is preferred.

Examples of the polyamine include single diamines, such as ethylenediamine, propylenediamine, butylenediamine, and pentylenediamine; polyalkylenepolyamines, such as diethylenetriamine, triethylenetetramine, tetraethylenepentamine, pentaethylenehexamine, di(methylethylene)triamine, dibutylenetriamine, tributylenetetramine, and pentapentylenehexamine; and piperazine derivatives, such as aminoethylpiperazine.

The substitution reaction of the active amine hydrogens may be performed by a known method, for example, a method which involves reacting the alkenyl succinic acid imide compound having active amine hydrogens with an alkyl halide that provides $R^C$ in the general formulae (b-1) and (b-2).

The imide compound (B) may further comprise a boron-modified succinic acid imide compound (By). The inclusion of the boron-modified succinic acid imide compound (By) in the imide compound (B) can enhance the high-temperature detergency of the lubricating oil composition.

At least one selected from a boron-modified product (B1y) of the succinic acid monoimide (B1x) and a boron-modified product (B2y) of the succinic acid bisimide (B2x) is preferred as the boron-modified succinic acid imide compound (By).

The content of boron atoms (By-B) derived from the boron-modified succinic acid imide compound (By) is preferably not more than 0.020% by mass, more preferably not more than 0.015% by mass, even more preferably not more than 0.010% by mass, and still more preferably not more than 0.005% by mass based on the total amount of the lubricating oil composition from the viewpoint of enhancing the wear resistance of the lubricating oil composition.

The total content of the non-boron-modified succinic acid imide compound (Bx) and the optional boron-modified succinic acid imide compound (By) in the imide compound (B) is preferably 70% by mass to 100% by mass, more preferably 80% by mass to 100% by mass, and even more preferably 90% by mass to 100% by mass, and still more preferably 100% by mass.

[Ratio [(By-B)/(B-N)]]

The mass ratio [(By-B)/(B-N)] of the content of boron atoms (By-B) derived from the boron-modified succinic acid imide compound (By) to the content of nitrogen atoms (B-N) derived from the imide compound (B) is preferably not more than 1.0, more preferably not more than 0.5, and even more preferably not more than 0.3.

In the lubricating oil composition of this embodiment, the content of the imide compound (B) in terms of nitrogen atoms is preferably not less than 0.010% by mass and not more than 0.10% by mass, more preferably not less than 0.012% by mass and not more than 0.080% by mass, even more preferably not less than 0.013% by mass and not more than 0.060% by mass, still more preferably not less than 0.014% by mass and not more than 0.050% by mass, and yet more preferably not less than 0.020% by mass and not more than 0.035% by mass based on the total amount of the lubricating oil composition from the viewpoint of enhancing the wear resistance.

In the lubricating oil composition of this embodiment, the content of the imide compound (B) in terms of nitrogen atoms is preferably adjusted to the above ranges. In particular, the content of the imide compound (B) is preferably 1.0% by mass to 10.0% by mass, more preferably 1.2% by mass to 8.0% by mass, even more preferably 1.3% by mass to 6.0% by mass, still more preferably 1.4% by mass to 4.0% by mass, and yet more preferably 2.0% by mass to 3.5% by mass based on the total amount (100% by mass) of the lubricating oil composition from the viewpoint of enhancing the wear resistance.

The lubricating oil composition of this embodiment may contain an ash-free dispersant other than the imide compound (B) as long as the effects of the present invention are not impaired, or may not contain such an ash-free dispersant.

Examples of the ash-free dispersant other than the imide compound (B) include a benzylamine, a boron-containing benzylamine, a succinic acid ester, and a monovalent or divalent carboxylic acid amide typified by a fatty acid or succinic acid.

From the viewpoint of enhancing the wear resistance, the lubricating oil composition of this embodiment preferably does not substantially contain a non-capped succinic acid imide compound (B') selected from a non-capped succinic acid monoimide (B'1) represented by the following general formula (i) and a non-capped succinic acid bisimide (B'2) represented by the following general formula (ii):

(i)

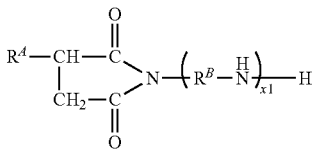

-continued (ii)

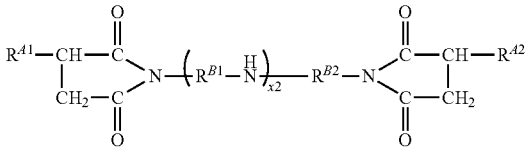

wherein $R^A$, $R^{A1}$, $R^{A2}$, $R^B$, $R^{B1}$, $R^{B2}$, x1, and x2 are the same as those of the general formulae (b-1) and (b-2).

As used herein, the term "non-capped" indicates that $R^C$ in the general formulae (b-1) and (b-2) is a hydrogen atom. On the other hand, the term "capped" indicates that $R^C$ in the general formulae (b-1) and (b-2) is an alkyl group having 1 to 10 carbon atoms, or a group represented by $—(AO)_n$-H where A represents an alkylene group having 2 to 4 carbon atoms, and n represents an integer of 1 to 10.

As used herein, the phrase "does not substantially contain a non-capped succinic acid imide compound (B')" indicates that the content of the non-capped succinic acid imide compound (B') is preferably less than 1.0% by mass, more preferably less than 0.1% by mass, even more preferably less than 0.01% by mass based on the total amount of the lubricating oil composition. Most preferably, the lubricating oil composition does not contain the non-capped succinic acid imide compound (B').

<Calcium-Based Detergent (C)>

The lubricating oil composition of this embodiment contains the calcium-based detergent (C). The inclusion of the calcium-based detergent (C) in the lubricating oil composition can enhance the high-temperature detergency.

Examples of the calcium-based detergent (C) include a calcium sulfonate represented by the following general formula (C1), a calcium phenate represented by the following general formula (C2), and a calcium salicylate represented by the following general formula (C3).

Among them, a calcium sulfonate is preferred from the viewpoint of enhancing the high-temperature detergency.

Such calcium-based detergents (C) may be used either singly or in a combination of two or more.

(C1)

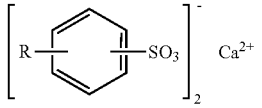

(C2)

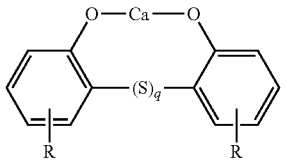

(C3)

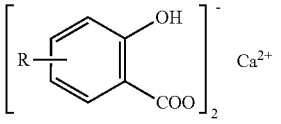

In the general formula (C2), q is an integer of not less than 0, preferably an integer of 0 to 3.

Rs are each independently a hydrogen atom or a hydrocarbon group.

The hydrocarbon group that can be selected for Rs may have a linear, branched or cyclic structure, preferably a branched structure.

Examples of the hydrocarbon group include an alkyl group, an alkenyl group, a cycloalkyl group, an aryl group, an alkylaryl group, and an arylalkyl group.

A branched alkyl group is especially preferred for the Rs.

The number of the carbon atoms of the hydrocarbon group is preferably from 3 to 26, more preferably from 7 to 24, and even more preferably from 10 to 20.

The number of the carbon atoms of a branched chain in the branched alkyl group is preferably from 1 to 8, more preferably from 2 to 6, and even more preferably from 2 to 5.

The calcium-based detergent (C) may be neutral, basic, or overbased; however, it is preferably basic or overbased, and more preferably overbased from the viewpoint of enhancing the high-temperature detergency.

As used herein, a basic or overbased metal-based detergent refers to a detergent obtained through a reaction between a metal and an acidic organic compound and containing the metal in an excessive amount higher than the stoichiometric amount necessary to neutralize the metal and the acidic organic compound. Thus, the "metal ratio" of the total chemical equivalent of the metal in a basic or overbased metal-based detergent to the chemical equivalent of the metal in a metal salt (neutral salt), obtained by reacting the acidic organic compound with the metal in the stoichiometric amount necessary for their neutralization, is higher than 1. The metal ratio of a basic or overbased metal-based detergent for use in this embodiment is preferably more than 1.3, more preferably 5 to 30, and even more preferably 7 to 22. The basic or overbased metal-based detergent can be exemplified by a compound comprising at least one selected from the group consisting of the metal salicylate, the metal phenate and the metal sulfonate described above, and containing a metal in an excessive amount.

The term "neutral" is herein defined as a base number of less than 50 mgKOH/g as measured by the below-described method, the term "basic" as a base number of not less than 50 mgKOH/g and less than 150 mgKOH/g, and the term "overbased" as a base number of not less than 150 mgKOH/g.

When the calcium-based detergent (C) is a calcium sulfonate, the base number of the calcium sulfonate is preferably not less than 5 mgKOH/g, more preferably not less than 100 mgKOH/g, even more preferably not less than 150 mgKOH/g, and still more preferably not less than 250 mgKOH/g, and is preferably not more than 500 mgKOH/g, more preferably not more than 450 mgKOH/g, and even more preferably not more than 400 mgKOH/g.

When the calcium-based detergent (C) is a calcium phenate, the base number of the calcium phenate is preferably not less than 50 mgKOH/g, more preferably not less than 100 mgKOH/g, even more preferably not less than 150 mgKOH/g, and still more preferably not less than 200 mgKOH/g, and is preferably not more than 500 mgKOH/g, more preferably not more than 450 mgKOH/g, and even more preferably not more than 400 mgKOH/g.

When the calcium-based detergent (C) is a calcium salicylate, the base number of the calcium salicylate is preferably not less than 50 mgKOH/g, more preferably not less than 100 mgKOH/g, even more preferably not less than 150 mgKOH/g, and still more preferably not less than 200 mgKOH/g, and is preferably not more than 500 mgKOH/g, more preferably not more than 450 mgKOH/g, and even more preferably not more than 400 mgKOH/g.

As used herein, the "base number" refers to a base number measured by the perchloric acid method in accordance with JIS K 2501:2003.

In a lubricating oil composition according to one embodiment of the present invention, the content of calcium atoms derived from the calcium-based detergent (C) is preferably 0.005% by mass to 0.40% by mass, more preferably 0.010% by mass to 0.35% by mass, even more preferably 0.050% by mass to 0.30% by mass, and still more preferably 0.10% by mass to 0.25% by mass based on the total amount of the lubricating oil composition from the viewpoint of enhancing the high-temperature detergency.

In a lubricating oil composition according to one embodiment of the present invention, the content of the calcium-based detergent (C) may be adjusted such that the content of calcium atoms derived from the calcium-based detergent (C) falls in the above ranges. More specifically, the content of the calcium-based detergent (C) is preferably not less than 0.5% by mass and not more than 5.0% by mass, more preferably not less than 1.0% by mass and not more than 3.0% by mass, and even more preferably not less than 1.5% by mass and not more than 2.0% by mass based on the total amount of the lubricating oil composition.

<Polymer Component (D)>

The lubricating oil composition of this embodiment contains the polymer component (D).

The polymer component (D) has a mass average molecular weight (Mw) of not less than 10,000 and not more than 50,000, and comprises at least one selected from an olefin polymer (D1) and a polymethacrylate (D2).

The polymer component (D) can function as an oil film retention improver in the lubricating oil composition of this embodiment.

If the lubricating oil composition does not contain the polymer component (D), it is difficult to ensure good oil film retention.

If the lubricating oil composition contains a polymer component having a mass average molecular weight (Mw) of less than 10,000 instead of the polymer component (D), the composition cannot have good oil film retention. If the lubricating oil composition contains a polymer component having a mass average molecular weight (Mw) of more than 50,000 instead of the polymer component (D), the polymer component cannot enter, for example, a sliding portion in an engine, and therefore cannot achieve an oil film retention improving effect.

Further, if the lubricating oil composition contains a polymer component, which is different from the olefin polymer (D1) and the polymethacrylate (D2), instead of the polymer component (D), the composition cannot have good oil film retention.

The polymer component (D) comprises at least one selected from the olefin polymer (D1) and the polymethacrylate (D2).

The constituent monomer(s) of the olefin polymer (D1) is, for example, at least one selected from ethylene, propylene, 1-butene, 1-pentene, 1-hexene, 1-heptene, 1-octene, 1-nonene, and 1-decene. A copolymer comprising a combination of two or more of these monomers may also be used.

The olefin polymer (D1) may include poly-α-olefin (PAO), an ethylene-propylene copolymer, polybutene, etc. Among them, poly-α-olefin (PAO) and an ethylene-propylene copolymer are preferred.

Either one of the olefin polymer (D1) and the polymethacrylate (D2), or a combination thereof may be used as the polymer component (D).

In the polymer component (D), the content of at least one selected from the olefin polymer (D1) and the polymethacrylate (D2) is preferably 70% by mass to 100% by mass, more preferably 80% by mass to 100% by mass, even more preferably 90% by mass to 100% by mass, and still more preferably 100% by mass.

The mass average molecular weight (Mw) of the polymer component (D) is not less than 10,000 and not more than 50,000, preferably not less than 10,000 and not more than 40,000, more preferably not less than 10,000 and not more than 30,000, and especially preferably not less than 10,000 and not more than 15,000 from the viewpoint of achieving good shear stability while ensuring good oil film retention, and adjusting the flash point and the evaporative loss to appropriate ranges.

When the polymer component (D) is composed of the olefin polymer (D1), the mass average molecular weight (Mw) is preferably not less than 10,000 and not more than 20,000, more preferably not less than 12,000 and not more than 18,000, even more preferably not less than 14,000 and not more than 16,000, and still more preferably not less than 14,000 and not more than 15,000.

When the polymer component (D) is composed of the polymethacrylate (D2), the mass average molecular weight (Mw) is preferably not less than 20,000 and not more than 50,000, more preferably not less than 30,000 and not more than 40,000, and even more preferably not less than 32,000 and not more than 35,000.

The mass average molecular weight (Mw) of the polymer component (D) is measured by gel permeation chromatography, followed by calculation in terms of polystyrene.

While there is no particular limitation on the content of the polymer component (D), it is preferably not less than 0.05% by mass and not more than 10.0% by mass, more preferably not less than 0.1% by mass and not more than 4.0% by mass, even more preferably not less than 0.3% by mass and not more than 3.0% by mass, and still more preferably not less than 0.5% by mass and not more than 2.0% by mass based on the total amount of the lubricating oil composition from the viewpoint of achieving good oil film retention.

In view of ease of handling, solubility in the base oil (A), etc., the polymer component (D), in the form of a solution in which the polymer component (D) is diluted or dissolved in part of the base oil (A), may be herein mixed with the other components. In such a case, the above-described content of the polymer component (D) refers to the content in terms of the active component (resin component) excluding the diluent oil.

<Zinc Dithiophosphate (E)>

The lubricating oil composition of this embodiment contains the zinc dithiophosphate (E).

Either a single agent or a combination of two or more agents may be used as the zinc dithiophosphate (E).

The zinc dithiophosphate (E) can be exemplified by a compound represented by the following general formula (d-1):

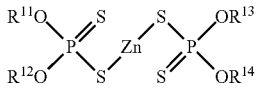

(d-1)

wherein $R^{11}$ to $R^{14}$ each independently represent a hydrocarbon group having 1 to 24 carbon atoms.

Examples of the hydrocarbon group represented by each of $R^{11}$ to $R^{14}$ include a linear or branched alkyl group having 1 to 24 carbon atoms, a linear or branched alkenyl group having 3 to 24 carbon atoms, a cycloalkyl group or a linear or branched alkylcycloalkyl group having 5 to 13 carbon atoms, an aryl group or a linear or branched alkylaryl group having 6 to 18 carbon atoms, and an arylalkyl group having 7 to 19 carbon atoms. Among them, a linear or branched alkyl group having 1 to 24 carbon atoms is preferred, and a branched alkyl group having 1 to 24 carbon atoms is more preferred. The number of carbon atoms of the branched alkyl group is preferably 2 to 12, and more preferably 3 to 6. Examples of the branched alkyl group having 1 to 24 carbon atoms include an iso-propyl group, an iso-butyl group, a sec-butyl group, a tert-butyl group, an iso-pentyl group, a tert-pentyl group, an iso-hexyl group, a 2-ethylhexyl group, an iso-nonyl group, an iso-decyl group, an iso-tridecyl group, an iso-stearyl group, and an iso-icosyl group. Among them, a sec-butyl group is preferred.

A zinc dialkyldithiophosphate, especially a zinc secondary dialkyldithiophosphate, is preferred as the zinc dithiophosphate (E).

In the lubricating oil composition of this embodiment, the content of phosphorus atoms (E-P) derived from the zinc dithiophosphate (E) is preferably not more than 0.10% by mass, more preferably not more than 0.080% by mass, even more preferably not more than 0.070% by mass, and still more preferably not more than 0.065% by mass based on the total amount of the lubricating oil composition from the viewpoint of reducing the amount of emission of phosphorus atoms.

In the lubricating oil composition of this embodiment, the content of the zinc dithiophosphate (E) is preferably adjusted such that the content of phosphorus atoms falls in the above ranges. More specifically, the content of the zinc dithiophosphate (E) is preferably less than 1.0% by mass, more preferably less than 0.9% by mass, and even more preferably less than 0.8% by mass and, from the viewpoint of enhancing the wear resistance, it is preferably not less than 0.1% by mass, more preferably not less than 0.5% by mass based on the total amount (100% by mass) of the lubricating oil composition.

[Ratio [(E-P)/(B-N)]]

The mass ratio [(E-P)/(B-N)] of the content of phosphorus atoms (E-P) derived from the zinc dithiophosphate (E) to the content of nitrogen atoms (B-N) derived from the imide compound (B) is preferably not less than 0.5 and not more than 5.0, more preferably not less than 0.5 and not more than 4.0, and even more preferably not less than 1.0 and not more than 3.5.

<Other Components>

The lubricating oil composition of this embodiment may contain components other than the above-described components as long as the effects of the present invention are not impaired.

Examples of additives as the other components include an antioxidant, a metal-based detergent other than the calcium-based detergent (C), and an anti-foaming agent.

Either a single additive or a combination of two or more additives may be used as each of the other components.

Examples of the antioxidant include an amine-based antioxidant, a phenol-based antioxidant, a molybdenum-based antioxidant, a sulfur-based antioxidant, and a phosphorus-based antioxidant. Among them, at least one selected from an amine-based antioxidant and a phenol-based antioxidant is preferred.

The metal-based detergent other than the calcium-based detergent (C) can be exemplified by a metal salicylate, a metal phenate and a metal sulfonate whose metal is different from calcium.

The metal different from calcium may be, for example, an alkali metal or an alkaline earth metal. Specific examples include sodium, magnesium and barium, and magnesium is particularly preferred.

Examples of the anti-foaming agent include a silicone oil, a fluorosilicone oil, and a fluoroalkyl ether.

The content of each of the above-described other components can be appropriately adjusted within a range which does not impair the effects of the present invention, and it is generally 0.001% by mass to 15% by mass, preferably 0.005% by mass to 10% by mass, more preferably 0.01% by mass to 7% by mass, and even more preferably 0.03% by mass to 5% by mass based on the total amount (100% by mass) of the lubricating oil composition.

In view of ease of handling, solubility in the base oil (A), etc., an additive(s) as the other component(s), in the form of a solution in which the additive is diluted or dissolved in part of the base oil (A), may be herein mixed with the other components. In such a case, the above-described content of the additive(s) refers to the content in terms of the active component (resin component) excluding the diluent oil.

[Ph,sical Properties of Lubricating Oil Composition]

The 100° C. kinematic viscosity of the lubricating oil composition of this embodiment is preferably not less than 4.0 $mm^2/s$, more preferably not less than 5.0 $mm^2/s$, even more preferably not less than 6.1 $mm^2/s$, still more preferably not less than 6.9 $mm^2/s$, and yet more preferably not less than 6.9 $mm^2/s$. The 100° C. kinematic viscosity of the lubricating oil composition of this embodiment is preferably less than 22.0 $mm^2/s$, more preferably less than 20.0 $mm^2/s$, even more preferably less than 16.3 $mm^2/s$, still more preferably less than 12.5 $mm^2/s$, yet more preferably less than 9.3 $mm^2/s$, and yet more preferably less than 8.2 $mm^2/s$. When the 100° C. kinematic viscosity is not less than 4.0 $mm^2/s$, it is easy to ensure good wear resistance. When the 100° C. kinematic viscosity is low, while it is easy to ensure good fuel economy, it is difficult to retain an oil film. However, the lubricating oil composition of this embodiment has good oil film retention even when the 100° C. kinematic viscosity is less than 22.0 $mm^2/s$. Thus, the lubricating oil composition can achieve both good fuel economy and good oil film retention.

The 100° C. kinematic viscosity can be measured or calculated in accordance with JIS K 2283:2000.

The 40° C. kinematic viscosity of the lubricating oil composition of this embodiment is preferably not less than 10.0 $mm^2/s$ and not more than 150.0 $mm^2/s$, more preferably not less than 20.0 $mm^2/s$ and not more than 100.0 $mm^2/s$, and even more preferably not less than 30.0 $mm^2/s$ and not more than 60.0 $mm^2/s$. The 40° C. kinematic viscosity of the lubricating oil composition of this embodiment is preferably not less than 40.0 $mm^2/s$ and not more than 140.0 $mm^2/s$, more preferably not less than 60.0 $mm^2/s$ and not more than 130.0 $mm^2/s$, and even more preferably not less than 80.0 $mm^2/s$ and not more than 120.0 $mm^2/s$. When the 40° C. kinematic viscosity lies in the above ranges, the lubricating oil composition can achieve both good fuel economy and good oil film retention.

The viscosity index of the lubricating oil composition of this embodiment is preferably not less than 80, more preferably not less than 85, even more preferably not less than 90, and still more preferably not less than 95. When the viscosity index is not less than 80, the temperature-dependent change in the viscosity is small.

The 40° C. kinematic viscosity and the viscosity index can be measured or calculated in accordance with JIS K 2283: 2000.

High-temperature high-shear viscosity (HTHS viscosity) refers to a viscosity as measured under the conditions of a high temperature (150° C.) and a shear rate of $10^6$ $s^{-1}$.

The high-temperature high-shear viscosity at 150° C. (150° C. HTHS viscosity) of the lubricating oil composition of this embodiment is preferably not less than 1.7 mPa·s and not more than 3.7 mPa·s, more preferably not less than 2.0 mPa·s and not more than 3.5 mPa·s, even more preferably not less than 2.3 mPa·s and not more than 2.9 mPa·s, and still more preferably not less than 2.3 mPa·s and not more than 2.6 mPa·s.

When the HTHS viscosity at 150° C. is in the above ranges, the lubricating oil composition has a low viscous resistance and a low energy loss while ensuring oil film retention. Thus, the fuel economy can be improved.

The 150° C. HTHS viscosity can be measured or calculated in accordance with JPI-5S-36-03.

[Contents of Boron Atoms, Calcium Atoms, Phosphorus Atoms and Zinc Atoms]

The content of boron atoms in the lubricating oil composition of this embodiment is preferably not more than 0.010% by mass, more preferably not more than 0.008% by mass, and even more preferably not more than 0.006% by mass based on the total amount of the lubricating oil composition. When the lubricating oil composition contains boron atoms, the content of boron atoms is generally not less than 0.001% by mass based on the total amount of the lubricating oil composition.

The content of calcium atoms in the lubricating oil composition of this embodiment is preferably not more than 0.50% by mass, more preferably not more than 0.40% by mass, and even more preferably not more than 0.30% by mass based on the total amount of the lubricating oil composition. The content of calcium atoms is preferably not less than 0.05% by mass, more preferably not less than 0.10% by mass, and even more preferably not less than 0.15% by mass based on the total amount of the lubricating oil composition.

The content of phosphorus atoms in the lubricating oil composition of this embodiment is preferably not more than 0.080% by mass, more preferably not more than 0.070% by mass, even more preferably not more than 0.065% by mass, and still more preferably not more than 0.062% by mass based on the total amount of the lubricating oil composition. The content of phosphorus atoms is preferably not less than 0.010% by mass, more preferably not less than 0.050% by mass based on the total amount of the lubricating oil composition.

The content of zinc atoms in the lubricating oil composition of this embodiment is preferably not more than 0.090% by mass, more preferably not more than 0.080% by mass, and even more preferably not more than 0.075% by mass based on the total amount of the lubricating oil composition. The content of zinc atoms is preferably not less than 0.010% by mass, more preferably not less than 0.050% by mass based on the total amount of the lubricating oil composition.

The respective contents of boron atoms, calcium atoms, phosphorus atoms and zinc atoms can be measured in accordance with JPI-5S-38-03.

[Content of Nitrogen Atoms]

In the lubricating oil composition of this embodiment, the content (total content) of nitrogen atoms (N), including nitrogen atoms derived from the imide compound (B) and nitrogen atoms derived from a component(s) other than the imide compound (B), is preferably not less than 0.010% by mass and not more than 0.10% by mass, more preferably not less than 0.012% by mass and not more than 0.080% by mass, even more preferably not less than 0.013% by mass and not more than 0.060% by mass, and still more preferably not less than 0.014% by mass and not more than 0.050% by mass based on the total amount of the lubricating oil composition from the viewpoint of enhancing the wear resistance.

The content of nitrogen atoms can be measured in accordance with JIS K 2609:1998.

An amine-based antioxidant, for example, can be used as the nitrogen atom-containing component other than the imide compound (B).

[Wear Resistance]

The wear resistance of the lubricating oil composition of this embodiment can be evaluated using, for example, a Falex Block-on-Ring wear resistance test machine (LFW-1). In particular, the wear resistance can be evaluated by the method described in the below-described Examples. The wear width of a test specimen, which has been subjected to the evaluation test described in the Examples, is preferably not more than 410 μm, more preferably not more than 385 μm, and even preferably not more than 380 μm.

[Oil Film Retention]

The oil film retention of the lubricating oil composition of this embodiment can be evaluated by the thickness of an oil film in an elasto-hydrodynamic lubrication (EHL) state. In particular, the oil film retention can be evaluated by the method described in the below-described Examples.

EHD2 (manufactured by PCS Instruments), for example, can be used as an EHL oil film thickness measuring apparatus.

The EHL oil film thickness, measured by the method described in the below-described Examples, is preferably not less than 17.0 nm, more preferably not less than 19.0 nm, and even more preferably not less than 20.0 nm.

[Application of Lubricating Oil Composition]

The lubricating oil composition of this embodiment is excellent in the wear resistance and the oil film retention.

The lubricating oil composition of this embodiment is preferably used in an internal combustion engine, more preferably in an internal combustion engine of a four-wheel vehicle or a motorcycle, and even more preferably in a motorcycle engine.

A number of rotating shafts and a number of bearings that hold the shafts are used in an automobile engine.

Known types of bearings include a sliding bearing in which an oil film of a lubricant, which lies between a shaft and the bearing, reduces friction between them, and a rolling bearing in which an oil film supports a rotating body, such as a ball or a roller, to reduce friction. A ball bearing, a roller bearing, a needle bearing, and so on, which differ in the shape of a rotating body, are widely used as a rolling bearing.

A ball bearing or a roller bearing generally includes an outer race, an inner race, a rotating body, and a retainer for retaining the position of the rotating body. On the other hand, a needle bearing, depending on the shape of its retainer, can be composed solely of a rotating body and the retainer. Such a needle bearing, having no outer and inner races, can be made lighter and smaller-sized as compared to a ball bearing or a roller bearing.

A rolling bearing, especially a needle bearing, is frequently used in a motorcycle engine from the viewpoint of simplifying the engine structure and reducing the size of the engine. Also in a four-wheel vehicle, a needle bearing is sometimes used in a roller-type valve train.

However, compared to a sliding bearing, a rolling bearing has a small contact area with a shaft. Therefore, if a lubricating oil composition has insufficient oil film retention, an oil film cannot be retained appropriately on a sliding portion in an engine, resulting in increased friction. This could cause damage to an engine part due to its fatigue or wear. The lubricating oil composition of this embodiment, which is excellent in the oil film retention, can therefore be advantageously used for a rolling bearing or the like.

[Method for Producing Lubricating Oil Composition]

According to an embodiment of the present invention, there is provided a method for producing a lubricating oil composition, comprising a step of mixing a base oil (A), an imide compound (B), a calcium-based detergent (C), a polymer component (D), and a zinc dithiophosphate (E), wherein the imide compound (B) comprises at least one non-boron-modified succinic acid imide compound (Bx) selected from a succinic acid monoimide (B1x) represented by the following general formula (b-1) and a succinic acid bisimide (B2x) represented by the following general formula (b-2):

(b-1)

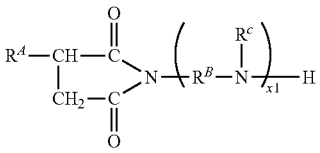

(b-2)

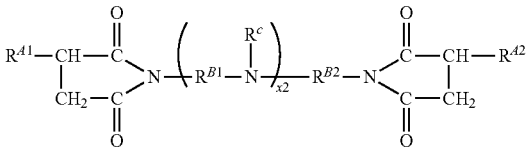

wherein $R^A$, $R^{A1}$, and $R^{A2}$ are each independently an alkenyl group having a mass average molecular weight (Mw) of 500 to 4,000, $R^B$, $R^{B1}$, and $R^{B2}$ are each independently an alkylene group having 2 to 5 carbon atoms, $R^C$ is an alkyl group having 1 to 10 carbon atoms or a group represented by $—(AO)_n$-H where A represents an alkylene group having 2 to 4 carbon atoms, and n represents an integer of 1 to 10, and x1 is an integer of 1 to 10, and x2 is an integer of 1 to 10, and wherein the polymer compound (D) has a mass average molecular weight (Mw) of not less than 10,000 and not more than 50,000, and comprises at least one selected from an olefin polymer (D1) and a polymethacrylate (D2).

There is no particular limitation on a method for mixing the above components. For example, it is possible to use a method in which the imide compound (B), the calcium-based detergent (C), the polymer component (D), and the zinc dithiophosphate (E) are added to the base oil (A), and then the components are mixed.

The production method may further comprise a step of adding the above-described other component(s).

Each component may be added in the form of a solution (dispersion) in, for example, a diluent oil. Further, the production method preferably comprises a step of adding the components, and then stirring and uniformly dispersing the components by a known method.

EXAMPLES

The following examples illustrate the present invention in greater detail and are not intended to limit the scope of the invention. Various properties and parameters of lubricating oil compositions and their components, used in Examples and Comparative Examples, were measured by the following methods.

[40° C. Kinematic Viscosity, 100° C. Kinematic Viscosity, and Viscosity Index]

The 40° C. kinematic viscosity, the 100° C. kinematic viscosity, and the viscosity index were measured or calculated in accordance with JIS K 2283:2000.

[150° C. HTHS Viscosity]

The 150° C. HTHS viscosity was measured or calculated in accordance with JPI-5S-36-03.

[Contents of Boron Atoms, Calcium Atoms, Phosphorus Atoms and Zinc Atoms]

The contents of boron atoms, calcium atoms, phosphorus atoms and zinc atoms were measured in accordance with JPI-5S-38-03.

[Content of Nitrogen Atoms]

The content of nitrogen atoms (total amount measured) was measured in accordance with JIS K 2609:1998.

The measured content of nitrogen atoms includes the content of nitrogen atoms derived from an antioxidant. Therefore, the theoretical value was calculated from the content of the imide compound and from the content of nitrogen atoms in the imide compound.

[Atomic Content Ratio]

From the contents of various atoms determined above, the ratio [(By-B)/(B-N)] of the content of boron atoms (By-B) derived from the boron-modified succinic acid imide compound (By) to the content of nitrogen atoms (B-N) derived from the imide compound (B) was calculated by dividing the content of boron atoms (By-B) by the content of nitrogen atoms (B-N).

Further, from the contents of various atoms determined above, the ratio [(E-P)/(B-N)] of the content of phosphorus atoms (E-P) derived from the zinc dithiophosphate (E) to the content of nitrogen atoms (B-N) derived from the imide compound (B) was calculated by dividing the content of phosphorus atoms (E-P) by the content of nitrogen atoms (B-N).

<Base Number>

The base number of the calcium-based detergent (C) was measured by the perchloric acid method in accordance with JIS K 2501:2003.

[Examples 1 to 9 and Comparative Examples 1 to 4]

The following components were thoroughly mixed in the amounts shown in Tables 1 to 3 to obtain lubricating oil compositions.

Details of the components used in Examples 1 to 9 and Comparative Examples 1 to 4 are as follows.

<Base Oil (A)>

Base oil (A1): mineral oil (API Base Oil Category: Group III, 40° C. kinematic viscosity: 32.7 $mm^2/s$, 100° C. kinematic viscosity: 6.0 $mm^2/s$, viscosity index: 132)

Base oil (A2): mineral oil (API Base Oil Category: Group II, 40° C. kinematic viscosity: 88.7 $mm^2/s$, 100° C. kinematic viscosity: 10.2 $mm^2/s$, viscosity index: 96)

<Imide compound (B)>

Non-boron-modified succinic acid imide compound (Bx): capped non-boron-modified alkenyl succinic acid bisimide (succinic acid bisimide (B2x) represented by the general formula (b-2). In the general formula (b-2), $R^{A1}$ and $R^{A2}$ are each a polybutenyl group having a mass average molecular weight (Mw) of 2,300, $R^{B1}$ and $R^{B2}$ are each an ethylene group, $R^C$ is a group represented by $—CH_2CH_2OCH_2CH_2OH$, and x2 is 5. The content of nitrogen atoms: 1.0% by mass)

Boron-modified succinic acid imide compound (By): capped boron-modified alkenyl succinic acid imide (polybutene backbone, the content of nitrogen atoms: 2.3% by mass, the content of boron atoms: 1.9% by mass)

Non-capped succinic acid imide compound (B'): unmodified alkenyl succinic acid bisimide (non-capped succinic acid bisimide (B'2) represented by the general formula (ii). In the general formula (ii), $R^{A1}$ and $R^{A2}$ are each a polybutenyl group having a mass average molecular weight (Mw) of 950, $R^{B1}$ and $R^{B2}$ are each an ethylene group, and x2 is 3. The content of nitrogen atoms: 1.9% by mass)

<Calcium-Based Detergent (C)>

Calcium-based detergent (C1): calcium sulfonate with a branched alkyl group having a branched chain of a butyl group and having 16 carbon atoms (including the number of the carbon atoms of the branched chain) (base number: 300 mgKOH/g, the content of calcium atoms: 11.6% by mass)

<Polymer Component (D)>

Polymer component (D1-1): ethylene-propylene copolymer (product name: LUCANT HC-2000 (registered trademark), manufactured by Mitsui Chemicals, Inc., mass average molecular weight (Mw): 14,000)

Polymer component (D1-2): poly-α-olefin (PAO, mass average molecular weight (Mw): 16,000)

Polymer component (D2): polymethacrylate (PMA, mass average molecular weight (Mw): 35,000)

Polymer component (D3): ethylene-propylene copolymer (product name: LUCANT HC-600 (registered trademark), manufactured by Mitsui Chemicals, Inc., mass average molecular weight (Mw): 7,000)

The mass average molecular weights (Mw) of the polymer components (D) were measured by gel permeation chromatography, followed by calculation in terms of polystyrene.

<Zinc Dithiophosphate (E)>

ZnDTP: Zinc secondary dialkyldithiophosphate (the content of phosphorus atoms: 7.1% by mass)

<Other Component>

Antioxidant: alkyl-substituted diphenylamine antioxidant

The following physical properties and the contents of elements were determined for the resulting lubricating oil compositions. The results are shown in Tables 1 to 3 below.

The following evaluations were performed on the resulting lubricating oil compositions. The results are shown in Tables 1 to 3 below.

[Evaluation of Wear Resistance]

Using a Falex Block-on-Ring wear resistance test machine (LFW-1), a test specimen was subjected to a wear resistance test using each of the resulting lubricating oil compositions under the following conditions, and the wear width of the test specimen was measured. The lubricating oil composition was rated as excellent in the wear resistance when the wear width of the test specimen was not more than 410 μm.

Test apparatus: Falex Block-on-Ring test machine (manufactured by Falex Corporation)
Ring: Falex S-10 Test-Ring (SAE 4620 steel)
Block: Falex H-60 Test-Block (SAE 01 steel)
Oil temp.: 100° C.
Load: 294 N
Speed: 250 rpm
Test time: 60 min
Amount of oil: 120 mL

[Evaluation of Oil Film Retention]

The thickness of an oil film of each of the resulting lubricating oil compositions was measured under the following conditions. The thickness of the oil film was measured three times under the same conditions, and the average of the three measured values was taken as the EHL oil film thickness of the lubricating oil composition. The lubricating oil composition was rated as excellent in the oil film retention when the EHL oil film thickness was not less than 17.0 nm.

Test apparatus: EHD2 (manufactured by PCS Instruments)
Test specimen: steel ball (diameter: 7.5 mm)
Disk: glass disc coated with $SiO_2$/Cr
Oil temp.: 80° C.
Load: 20 N (surface pressure: 0.5 GPa)
Speed: 100 mm/s
Slide-roll ratio (SRR): 200%

TABLE 1

| Components (unit) | | | | Examples 1 | 2 | 3 | 4 | 5 |
|---|---|---|---|---|---|---|---|---|
| Base oil (A) | | Base oil (A1) | mass % | 80.95 | 82.45 | 79.45 | 81.18 | 81.45 |
| | | Base oil (A2) | mass % | 12.00 | 12.00 | 12.00 | 12.00 | 12.00 |
| Imide compound (B) | | Non-boron-modified succinic acid imide compound (Bx) | mass % | 3.00 | 1.50 | 4.50 | 2.50 | 3.00 |
| | | Boron-modified succinic acid imide compound (By) | mass % | — | — | — | 0.27 | — |
| | | Non-capped succinic acid imide compound (B') | mass % | — | — | — | — | — |
| Calcium-based detergent (C) | | Calcium-based detergent (C1) | mass % | 1.71 | 1.71 | 1.71 | 1.71 | 1.71 |
| Polymer component (D) | | Polymer component (D1-1) | mass % | 1.00 | 1.00 | 1.00 | 1.00 | 0.50 |
| | | Polymer component (D1-2) | mass % | — | — | — | — | — |
| | | Polymer component (D2) | mass % | — | — | — | — | — |
| | | Polymer component (D3) | mass % | — | — | — | — | — |
| Zinc dithiophosphate (E) | | ZnDTP | mass % | 0.84 | 0.84 | 0.84 | 0.84 | 0.84 |
| Other component | | Antioxidant | mass % | 0.50 | 0.50 | 0.50 | 0.50 | 0.50 |
| Total | | | mass % | 100 | 100 | 100 | 100 | 100 |
| lubricating oil composition | Physical properties | 40° C. kinematic viscosity | $mm^2/s$ | 46.0 | 43.1 | 49.3 | 45.3 | 43.3 |
| | | 100° C. kinematic viscosity | $mm^2/s$ | 7.8 | 7.4 | 8.2 | 7.7 | 7.4 |
| | | 150° C. HTHS viscosity | mPa · s | 2.6 | 2.5 | 2.7 | 2.6 | 2.5 |
| | | viscosity index | — | 139 | 138 | 140 | 139 | 137 |
| | Content of atoms in lubricating oil composition | Boron (By-B) derived from imide compound (By) | mass % | 0.00 | 0.00 | 0.00 | 0.005 | 0.00 |
| | | Calcium derived from calcium-based detergent (C1) | mass % | 0.20 | 0.20 | 0.20 | 0.20 | 0.20 |
| | | Phosphorus (E-P) derived from zinc dithiophosphate (E) | mass % | 0.060 | 0.060 | 0.060 | 0.060 | 0.060 |
| | | Zinc derived from zinc dithiophosphate (E) | mass % | 0.070 | 0.070 | 0.070 | 0.070 | 0.070 |
| | | Nitrogen (total amount measured) | mass % | 0.045 | 0.030 | 0.060 | 0.045 | 0.045 |
| Theoretical value | | Nitrogen derived from imide compound (Bx), (By), (B') | mass % | 0.030 | 0.015 | 0.045 | 0.030 | 0.030 |
| Atomic content ratio | | Ratio [(By-B)/(B-N)] | — | 0.0 | 0.0 | 0.0 | 0.2 | 0.0 |
| | | Ratio [(E-P)/(B-N)] | — | 2.0 | 3.0 | 1.5 | 2.0 | 2.0 |
| Evaluation results | | Wear resistance (wear width) | μm | 378 | 385 | 401 | 387 | 389 |
| | | Oil film retention (EHL oil film thickness) | nm | 21.1 | 24.3 | 21.6 | 19.7 | 21.8 |

TABLE 2

| Components (unit) | | | | Examples 6 | 7 | 8 | 9 |
|---|---|---|---|---|---|---|---|
| Base oil (A) | | Base oil (A1) | mass % | 81.25 | 80.95 | 81.25 | 80.67 |
| | | Base oil (A2) | mass % | 12.00 | 12.00 | 12.00 | 12.00 |
| Imide compound (B) | | Non-boron-modified succinic acid imide compound (Bx) | mass % | 3.00 | 3.00 | 3.00 | 3.00 |
| | | Boron-modified succinic acid imide compound (By) | mass % | — | — | — | — |
| | | Non-capped succinic acid imide compound (B') | mass % | — | — | — | — |

TABLE 2-continued

| Components (unit) | | | | Examples 6 | 7 | 8 | 9 |
|---|---|---|---|---|---|---|---|
| Calcium-based detergent (C) | | Calcium-based detergent (C1) | mass % | 1.71 | 1.71 | 1.71 | 1.71 |
| Polymer component (D) | | Polymer component (D1-1) | mass % | 0.70 | — | — | 1.00 |
| | | Polymer component (D1-2) | mass % | — | 1.00 | — | — |
| | | Polymer component (D2) | mass % | — | — | 0.70 | — |
| | | Polymer component (D3) | mass % | — | — | — | — |
| Zinc dithiophosphate (E) | | ZnDTP | mass % | 0.84 | 0.84 | 0.84 | 1.12 |
| Other component | | Antioxidant | mass % | 0.50 | 0.50 | 0.50 | 0.50 |
| Total | | | mass % | 100 | 100 | 100 | 100 |
| lubricating oil composition | Physical properties | 40° C. kinematic viscosity | $mm^2/s$ | 44.4 | 42.4 | 42.3 | 46.0 |
| | | 100° C. kinematic viscosity | $mm^2/s$ | 7.6 | 7.3 | 7.4 | 7.8 |
| | | 150° C. HTHS viscosity | mPa · s | 2.5 | 2.4 | 2.5 | 2.6 |
| | | viscosity index | — | 138 | 136 | 141 | 139 |
| | Content of atoms in lubricating oil composition | Boron (By-B) derived from imide compound (By) | mass % | 0.00 | 0.00 | 0.00 | 0.00 |
| | | Calcium derived from calcium-based detergent (C1) | mass % | 0.20 | 0.20 | 0.20 | 0.20 |
| | | Phosphorus (E-P) derived from zinc dithiophosphate (E) | mass % | 0.060 | 0.060 | 0.060 | 0.080 |
| | | Zinc derived from zinc dithiophosphate (E) | mass % | 0.070 | 0.070 | 0.070 | 0.070 |
| | | Nitrogen (total amount measured) | mass % | 0.045 | 0.045 | 0.045 | 0.045 |
| Theoretical value | | Nitrogen derived from imide compound (Bx), (By), (B') | mass % | 0.030 | 0.030 | 0.030 | 0.030 |
| Atomic content ratio | | Ratio [(By-B)/(B-N)] | — | 0.0 | 0.0 | 0.0 | 0.0 |
| | | Ratio [(E-P)/(B-N)] | — | 2.0 | 2.0 | 2.0 | 2.0 |
| Evaluation results | | Wear resistance (wear width) | μm | 382 | 380 | 384 | 380 |
| | | Oil film retention (EHL oil film thickness) | nm | 22.6 | 17.0 | 18.8 | 18.9 |

TABLE 3

| Components (unit) | | | | Comp. Examples 1 | 2 | 3 | 4 |
|---|---|---|---|---|---|---|---|
| Base oil (A) | | Base oil (A1) | mass % | 82.24 | 82.41 | 81.95 | 80.67 |
| | | Base oil (A2) | mass % | 12.00 | 12.00 | 12.00 | 12.00 |
| Imide compound (B) | | Non-boron-modified succinic acid imide compound (Bx) | mass % | — | — | 3.00 | 3.00 |
| | | Boron-modified succinic acid imide compound (By) | mass % | 1.71 | — | — | — |
| | | Non-capped succinic acid imide compound (B') | mass % | — | 1.54 | — | — |
| Calcium-based detergent (C) | | Calcium-based detergent (C1) | mass % | 1.71 | 1.71 | 1.71 | 1.71 |
| Polymer component (D) | | Polymer component (D1-1) | mass % | 1.00 | 1.00 | — | — |
| | | Polymer component (D1-2) | mass % | — | — | — | — |
| | | Polymer component (D2) | mass % | — | — | — | — |
| | | Polymer component (D3) | mass % | — | — | — | 1.00 |
| Zinc dithiophosphate (E) | | ZnDTP | mass % | 0.84 | 0.84 | 0.84 | 1.12 |
| Other component | | Antioxidant | mass % | 0.50 | 0.50 | 0.50 | 0.50 |
| Total | | | mass % | 100 | 100 | 100 | 100 |
| lubricating oil composition | Physical properties | 40° C. kinematic viscosity | $mm^2/s$ | 42.5 | 43.1 | 40.8 | 44.5 |
| | | 100° C. kinematic viscosity | $mm^2/s$ | 7.3 | 7.4 | 7.1 | 7.6 |
| | | 150° C. HTHS viscosity | mPa · s | 2.5 | 2.5 | 2.4 | 2.6 |
| | | viscosity index | — | 137 | 137 | 135 | 138 |
| | Content of atoms in lubricating oil composition | Boron (By-B) derived from imide compound (By) | mass % | 0.040 | 0.00 | 0.00 | 0.00 |
| | | Calcium derived from calcium-based detergent (C1) | mass % | 0.20 | 0.20 | 0.20 | 0.20 |
| | | Phosphorus (E-P) derived from zinc dithiophosphate (E) | mass % | 0.060 | 0.060 | 0.060 | 0.060 |
| | | Zinc derived from zinc dithiophosphate (E) | mass % | 0.070 | 0.070 | 0.070 | 0.070 |
| | | Nitrogen (total amount measured) | mass % | 0.045 | 0.045 | 0.045 | 0.045 |
| Theoretical value | | Nitrogen derived from imide compound (Bx), (By), (B') | mass % | 0.030 | 0.030 | 0.030 | 0.030 |

TABLE 3-continued

| Components (unit) | | | Comp. Examples 1 | 2 | 3 | 4 |
|---|---|---|---|---|---|---|
| Atomic content ratio | Ratio [(By-B)/(B-N)] | — | 1.3 | 0.0 | 0.0 | 0.0 |
| | Ratio [(E-P)/(B-N)] | — | 2.0 | 2.0 | 2.0 | 2.0 |
| Evaluation results | Wear resistance (wear width) | μm | 414 | 433 | 410 | 400 |
| | Oil film retention (EHL oil film thickness) | nm | 18.1 | 18.2 | 15.3 | 15.5 |

The lubricating oil compositions of Examples 1 to 9, which satisfy all the features of the present invention, were found to be excellent in the wear resistance and the oil film retention.

On the other hand, the lubricating oil composition of Comparative Example 1, which does not contain the non-boron-modified succinic acid imide compound (Bx) and solely contains the boron-modified succinic acid imide compound (By) as the imide compound (B), and the lubricating oil composition of Comparative Example 2, which solely contains the non-capped imide compound (B') as the imide compound (B), were found to be poor in the wear resistance.

The lubricating oil composition of Comparative Example 3 which does not contain the polymer component (D), and the lubricating oil composition of Comparative Example 4 which contains a polymer component (D) having a mass average molecular weight (Mw) of less than 10,000 were found to be poor in the oil film retention.

The invention claimed is:

1. A lubricating oil composition, comprising:

(A) a base oil;

(B) an imide compound;

(C) a calcium-based detergent;

(D) a polymer component having a mass average molecular weight (Mw) in a range of from 10,000 to 50,000, and comprises a polyolefin and/or a polymethacrylate; and (E) a zinc dithiophosphate, wherein the imide compound (B) comprises non-boron-modified succinic acid imide compound (B1) comprising a succinic acid monoimide of formula (b-1) and/or a succinic acid bisimide of formula (b-2):

(b-1)

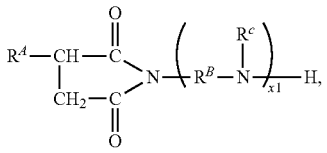

(b-2)

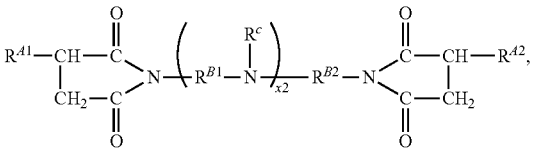

wherein $R^A$, $R^{A1}$, and $R^{A2}$ are each independently an alkenyl group having a mass average molecular weight (Mw) in a range of from 500 to 4,000, $R^B$, $R^{B1}$, and $R^{B2}$ are each independently an alkylene group having 2 to 5 carbon atoms, $R^C$ is an alkyl group having 1 to 10 carbon atoms or a group represented by —$(AO)_n$-H, A is an alkylene group having 2 to 4 carbon atoms, and n being an integer in a range of from 1 to 10, x1 is an integer in a range of from 1 to 10, and x2 is an integer in a range of from 1 to 10.

2. The composition of claim 1, wherein the imide compound (B) further comprises a boron-modified succinic acid imide (B2) compound a boron-modified succinic acid monoimide and/or a boron-modified of succinic acid bisimide, and wherein the boron-modified succinic acid imide compound (B2) comprises no more than 0.020 mass % of boron atoms, based on total lubricating oil composition mass.

3. The composition of claim 2, wherein a (B2)/(B1) mass ratio, of the boron atoms in the boron-modified succinic acid imide compound (B2) to the nitrogen atoms in the imide compound (B1), is not more than 1.0.

4. The composition of claim 1, wherein a (E)/(B) mass ratio, of the phosphorus atoms in the zinc dithiophosphate (E) to the nitrogen atoms in the imide compound (B), is in a range of from 0.5 to 5.0.

5. The composition of claim 1, having a content of nitrogen atoms in a range of from 0.010% to 0.10 mass %, based on total lubricating oil composition mass.

6. The composition of claim 1, wherein the calcium-based detergent (C) is a calcium sulfonate.

7. The composition of claim 1, having a kinematic viscosity at 100° C. in a range of from 4.0 to less than 20.0 $mm^2/s$.

8. A method for producing the lubricating oil composition of claim 1, the method comprising:

mixing the base oil (A), the imide compound (B), the calcium-based detergent (C), the polymer component (D), and the zinc dithiophosphate (E).

9. The composition of claim 1, comprising no non-capped succinic acid imide compound.

10. The composition of claim 1, wherein the imide compound (B) having no active amine hydrogen.

11. The composition of claim 1, comprising no boron-containing benzylamine.

12. The composition of claim 1, comprising no benzylamine compound.

13. The composition of claim 1, wherein $R^C$ in the imide compound (B) is the alkyl group having 1 to 10 carbon atoms.

14. The composition of claim 1, wherein $R^C$ in the imide compound (B) is the group represented by —$(AO)_n$-H.

15. The composition of claim 1, wherein the $R^C$ in the imide compound (B) is a methyl, ethyl, propyl, butyl, pentyl, hexyl group, heptyl, octyl group, 1,1-dimethylhexyl, 2-ethylhexyl, nonyl, 1,1-dimethylheptyl, or decyl group.

16. The composition of claim 1, comprising no boron-containing ash-free dispersant.

17. The composition of claim 1, having a boron atom content of no more than 0.008%, based on total composition amount.

18. The composition of claim 1, having a boron atom content of no more than 0.006%, based on total composition amount.

19. The composition of claim 1, having a boron atom content of no more than 0.001%, based on total composition amount.

20. The composition of claim 1, having a boron atom content of 0.00%, based on total composition amount.

* * * * *